US006006638A

United States Patent [19]

Eltringham

[11] Patent Number: 6,006,638

[45] Date of Patent: Dec. 28, 1999

[54] AUTOMATED SHEET METAL BLANKING APPARATUS

[75] Inventor: Kenneth Dale Eltringham, Shelby Township, Mich.

[73] Assignee: Kendor Steel Rule Die, Inc., Fraser, Mich.

[21] Appl. No.: 09/033,272

[22] Filed: Mar. 2, 1998

[51] Int. Cl.[6] ..... B23Q 7/00

[52] U.S. Cl. ..... 83/86; 83/167; 83/152; 83/402; 414/795.7; 414/797; 414/796.7; 414/790.1; 414/793; 271/18.1; 271/234

[58] Field of Search ..... 83/152, 167, 104, 83/402, 86; 271/3.23, 11, 18.1, 18.2, 104, 107, 234, 236, 240, 263, 265.04, 194; 414/796.7, 795.7, 797, 790.1, 790.7, 793, 793.8

[56] References Cited

U.S. PATENT DOCUMENTS

| | | | |
|---|---|---|---|
| 2,069,424 | 2/1937 | Seft . | |
| 2,324,380 | 7/1943 | Frei, Jr. . | |
| 3,216,297 | 11/1965 | Osborn, Jr. . | |
| 3,670,611 | 6/1972 | Jarman | 83/81 |
| 3,796,121 | 3/1974 | Scott | 83/451 |
| 3,830,121 | 8/1974 | Makeev et al. | 83/81 |
| 4,140,258 | 2/1979 | Gray | 225/2 |
| 4,361,062 | 11/1982 | Reiff | 83/71 |
| 4,392,766 | 7/1983 | Blunt | 414/113 |
| 4,433,774 | 2/1984 | Lopes | 198/689 |
| 4,474,094 | 10/1984 | Hanni et al. | 83/104 |
| 4,513,957 | 4/1985 | Schaefer, Jr. | 271/90 |
| 4,971,515 | 11/1990 | Pol et al. | 414/797 |
| 4,988,263 | 1/1991 | Odenthal | 414/795.8 |
| 5,031,892 | 7/1991 | Stieger | 271/10 |
| 5,036,736 | 8/1991 | Hillock et al. | 83/23 |
| 5,123,640 | 6/1992 | Rebeaud | 271/236 |
| 5,651,541 | 7/1997 | Prime | 271/18.1 |
| 5,820,539 | 10/1998 | Strahm | 493/412 |

*Primary Examiner*—M. Rachuba
*Assistant Examiner*—Stephen Choi
*Attorney, Agent, or Firm*—Fildes & Outland, P.C.

[57] ABSTRACT

An automated sheet metal blanking apparatus includes a loading table having a conveyor horizontally moveable between a loading position wherein sheet metal pieces are loaded onto the conveyor and a destacking station wherein the conveyor transfers the sheet metal pieces onto the destacking station for subsequent processing. A qualifier receives and positions destacked sheet metal pieces. A steel rule die blanking press receives prepositioned sheet metal pieces from the qualifier. The lower die includes mechanical positioners for final positioning the sheet metal pieces. A feed manipulator including an elongated arm mounts a plurality of controllable vacuum pickups operable for transferring sheet metal pieces between the destacking station, qualifier and blanking press. The feed manipulator is moveable over the destacking station and qualifier and moveable in between the upper and lower dies. An unloading table adjacent a scrap station includes a conveyor horizontally moveable between an unloading position wherein sized blanks are unloaded from the conveyor and a stacking station wherein the conveyor picks up the sized blanks. A discharge manipulator including an elongated arm mounts at least two distinct pluralities of independently controllable vacuum pickups and is operable for transferring sheet metal scraps and sized blanks from between the upper and lower blanking dies and over the scrap station wherein scrap is deposited through the operation of one of the pluralities of vacuum pickups, and over the unloading table. A controller in communication with the operating components of the blanking apparatus automatically controls the operation of the blanking apparatus.

10 Claims, 3 Drawing Sheets

AUTOMATED SHEET METAL BLANKING APPARATUS

FIELD OF THE INVENTION

This invention relates to apparatus for sheet metal blanking and more particularly to an automated sheet metal blanking apparatus for precisely blanking sheet steel pieces.

BACKGROUND OF THE INVENTION

It is known in the art that steel rule dies offer significant cost advantages over conventional forged and ground dies.

One known manually actuated, semi automatic apparatus for blanking sheet steel utilizes a suction cup array mounted on an elevating frame carried by an overhead trolley to pick up sheet steel pieces and deposit them onto a low friction platform. This trolley arrangement replaces manually feeding the press, thereby reducing manual labor, yet does not enhance production speed over operations that utilize manually fed presses. The low production speed of the known semi automatic apparatus does not allow it to be considered by the automotive industry for the production of panels for vehicles in lieu of hard tooling.

The sheet steel pieces are then pushed across the surface of the low friction platform onto the lower die of a steel rule die set mounted in a blanking press.

The upper die in this apparatus utilizes an array of suction cups thereon to retain the scrap to be removed manually from in between the die set. An unload table is moved into the press t o receive the blank after blanking and another suction cup array mounted on an elevating frame is used to lift the blank off the unload table.

In use, sliding the sheet steel across the low friction platform or using a roller conveyor to transfer the sheet metal, degrades the sheet steel surface and can inhibit the proper application of paint. In addition, the apparatus does not provide for precise positioning of consecutive pieces of sheet steel stock and thereby tends to greater waste. Furthermore, the manual removal of scrap from the press is undesirable and can lead to down time.

SUMMARY OF THE INVENTION

The present invention provides an automated sheet metal blanking apparatus having production speeds equivalent to speeds currently afforded in hard tool vehicle panel production.

The present invention also provides an automated sheet metal blanking apparatus wherein there is no relative sliding motion between sheet metal blank surfaces and the automated apparatus components.

The present invention further provides an automated sheet metal blanking apparatus that precisely positions consecutive pieces of sheet metal stock in a blanking press resulting in higher yields.

The present invention also provides an automated sheet metal blanking apparatus wherein scrap is automatically removed with the blank and handled outside the press.

More specifically, an automated sheet metal blanking apparatus constructed in accordance with the invention includes a loading table having a conveyor and a destacking station. The conveyor is horizontally moveable between a loading position wherein sheet metal pieces are loaded onto the conveyor and the destacking station wherein the conveyor transfers the sheet metal pieces onto the destacking station for subsequent processing. Within the destacking station magnetic separation means facilitates separation of an upper piece of sheet metal from the stack.

A qualifier including crowder locating means is adjacent the loading table for receiving and positioning destacked sheet metal pieces.

A blanking press including a blanking die set comprising a steel rule die receives prepositioned sheet metal pieces from the qualifier. The die set includes upper and lower dies. The lower die includes mechanical positioning means including one of gauge blocks and gauge pins for final positioning of the sheet metal pieces on the lower die. The sheet metal pieces are blanked upon actuation of the press.

A feed manipulator including an elongated arm mounts a plurality of controllable vacuum pickups operable for transferring sheet metal pieces between the destacking station, qualifier and blanking press. The feed manipulator is moveable over the destacking station and qualifier and moveable in between the upper and lower dies.

Preferably, the feed manipulator includes a sensor to sense the presence of more than one sheet of sheet metal being picked up. The sensor upon sensing the pick up of more than one sheet of sheet metal causes recycling of the system and magnetic separation means to allow separation of the stacked sheet metal sheets, which is critical to maintaining production speeds.

A scrap station is located adjacent the blanking press for receiving scrap portions of sheet metal after blanks are sized.

An unloading table adjacent the scrap station includes a conveyor and a stacking station. The conveyor is horizontally moveable between an unloading position wherein sized blanks are unloaded from the conveyor and the stacking station wherein the conveyor picks up the sized blanks. A discharge manipulator including an elongated arm mounting at least two distinct pluralities of independently controllable vacuum pickups is operable for transferring sheet metal scraps and sized blanks from between the upper and lower blanking dies to the scrap station where scrap is deposited through the operation of one of the pluralities of vacuum pickups, and to the unloading table where the sized blanks are deposited.

In one embodiment of the invention, the gauge blocks have an inclined positioning surface, sloping toward the center of the lower die wherein the gauge blocks are positioned in spaced proximity about the perimeter of the sheet metal piece to be processed. As the sheet metal is deposited by the feed manipulator elongated arm on the lower die, the sheet metal slides into proper position for blanking.

In an alternative embodiment of the invention used for blanking sheet steel pieces having prefabricated holes therein, the lower die includes gauge pins having an upwardly extending conical shape. The gauge pins penetrate the prefabricated holes in the sheet metal pieces thereby assuring proper alignment of the sheet metal pieces relative to the holes.

In accordance with the invention the feed manipulator and discharge manipulator are robotic. A controller controls the loading and unloading tables, feed and discharge manipulators and blanking press, thereby making the blanking apparatus fully automated.

These and other features and advantages of the invention will be more fully understood from the following detailed description of the invention taken together with the accompanying drawings.

DETAILED DESCRIPTION OF THE INVENTION

Figure 1:
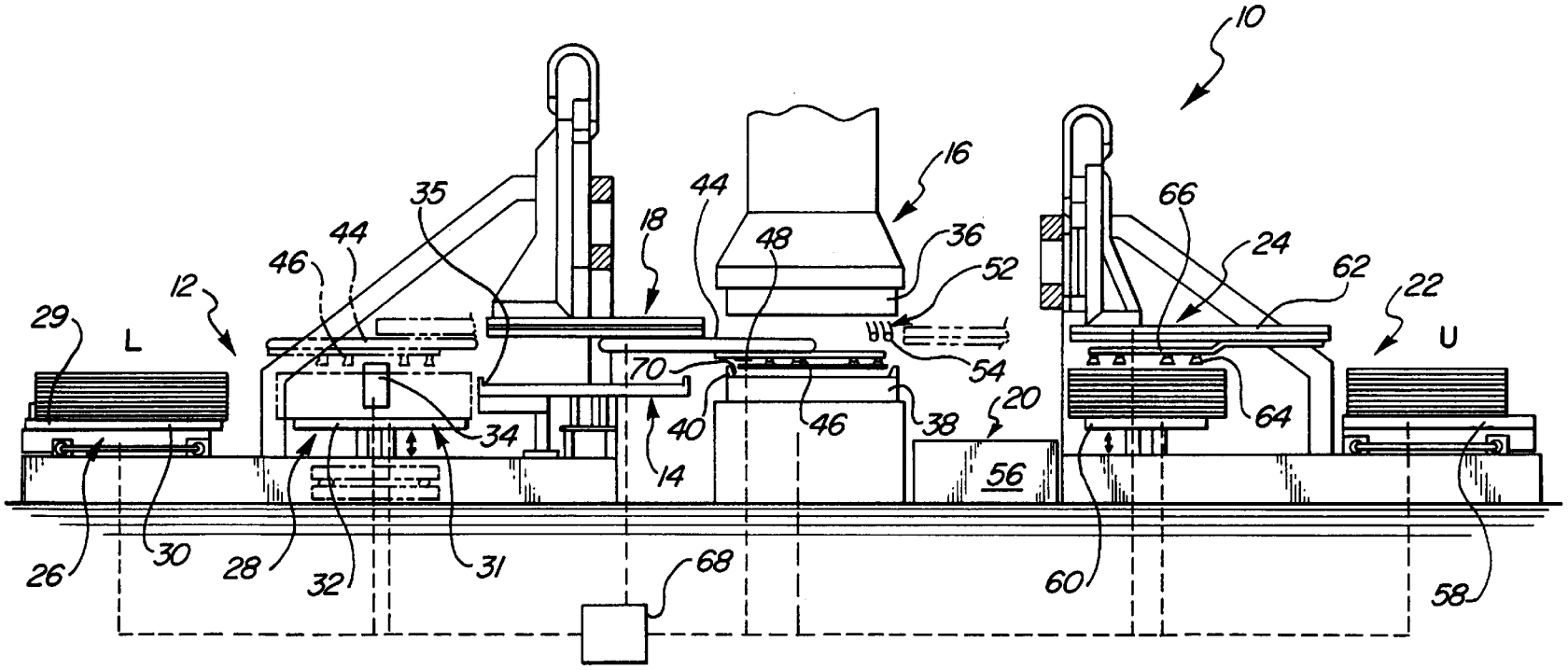
FIG. 1 is a schematic view of an automated sheet metal blanking apparatus including a loading table, qualifier, blanking press, feed manipulator, scrap station, unloading table, and discharge manipulator, constructed in accordance with the present invention.

Referring now to the drawings in detail, there is shown a fully automated sheet metal blanking apparatus 10 for handling sheet metal pieces and blanking the sheet metal pieces to form blanks of automobile body panels. As is hereinafter more fully described, the automated sheet metal blanking apparatus enhances production speed, matching hard tooling production speeds, while eliminating relative sliding motion between sheet metal blank surfaces and the automated apparatus and precisely positioning consecutive pieces of sheet metal stock for blanking.

In FIG. 1 there is shown a fully automated sheet metal blanking apparatus 10 including a loading table 12, a qualifier 14, a blanking press 16, a feed manipulator 18, a scrap station 20, an unloading table 22, and a discharge manipulator 24.

The loading table 12 includes a conveyor cart 26 and a destacking station 28. At a loading position L, distal from the destacking station 28, a stack of sheet metal pieces is loaded onto the conveyor cart 26. The conveyor cart 26 includes a support surface 29 defined in part by a plurality of horizontally disposed, longitudinally extending fingers 30 and is horizontally moveable between the loading position L and destacking station 28. Destacking station 28 includes another support surface 31 defined in part by a corresponding plurality of horizontally disposed, longitudinally extending interconnecting fingers 32. Fingers 32 of the destacking station are vertically moveable to elevational positions above and below the elevation of the fingers 30 of the conveyor cart 26.

At the destacking station 28, the conveyor cart 26 comes in with the support surface 29 at an elevation higher than the support surface of the destacking station 28. A stack of sheet metal pieces for subsequent processing is transferred from the conveyor cart 26 as the destacking station support table is raised from an elevation below that of the conveyor cart, fingers 30, 32 passing each other, to an elevation above the conveyor cart. The cart 26 then returns to its loading position L to receive another stack of sheet metal. In this way the sheet metal panels are transferred without sliding movement and the sheet metal pieces are uninterruptably supplied.

Destacking station 28 also includes a magnetic separating means 34 for separating stacked sheet steel pieces for subsequent transfer.

The qualifier 14 includes known crowder locating means 35 for receiving individual pieces of destacked sheet metal and prepositioning each sheet metal piece for transfer into the blanking press 16.

Blanking press 16 includes upper and lower steel rule blanking dies 36, 38 for blanking blanks from the sheet metal pieces. The lower die 38 includes mechanical positioning means including one of gauge blocks 40 and gauge pins 42, hereinafter more fully described for positioning the sheet metal pieces with accurate precision between the die set.

Feed manipulator 18 includes an elongated arm 44 mounting a plurality of controllable vacuum pickups 46. Elongated arm 44 is robotic and, through the operation of the controllable vacuum pickups 46, transfers sheet metal pieces between the destacking station 28, qualifier 14 and blanking press 16. The elongated arm 44 of the feed manipulator 18 is moveable over the destacking station 28 where the vacuum pickups 46 pick up a sheet metal piece and transfer it onto the qualifier 14 by releasing the sheet metal piece for prepositioning by the crowder locating means. Feed manipulator 18 may include a sensor 48 for sensing the pick up of more than one sheet metal panel. In this case, the manipulator 18 is recycled to the magnetic separation means 34 to separate the stacked sheet metal panels.

The prepositioned sheet metal piece is then lifted by the vacuum pickups 46 on the elongated arm 44 and moved in between the upper and lower steel rule dies 36, 38. The prepositioned alignment of the sheet metal piece is maintained as the sheet metal piece is transferred from the qualifier 14 to the blanking press 16. Inside the blanking press 16, the sheet metal piece is deposited, through the release of vacuum pressure of the vacuum pickups 46, onto the lower die 38 whereby the positioning means 40, 42 position the sheet metal piece on the lower die. As the upper and lower dies 36, 38 are moved together, the sheet metal piece is blanked. After the blank and scrap are removed from the press 16, as further hereinafter more fully described, air blast means 52 comprising a plurality of nozzles 54 for directing high pressure air, is actuated for blowing air to remove any particulate left in between the dies 36, 38.

Scrap station 20 is adjacent the blanking press 16 and includes scrap receiving means 56 such as a removable bin for receiving scrap portions of the sheet metal after the blanks are sized.

Unloading table 22 is adjacent the scrap station 20 and includes a conveyor cart 58 and a stacking station 60 similar in construction and operation to that of the loading table 12.

Discharge manipulator 24 includes an elongated arm 62 mounting at least two distinct pluralities 64, 66 of independently controllable vacuum pickups. Elongated arm 62 is moveable in between the upper and lower blanking dies 36, 38 where the two pluralities 64, 66 of independently controllable vacuum picks can be actuated to engage the sized blank and scrap portions of the sheet metal piece. Discharge manipulator 24 is moveable to position the sized blank and scrap metal portions over the scrap station 20 where the scrap portion of the sheet metal piece can be deposited through the release of vacuum by one of the pluralities 64 of independently controllable pickups. The discharge manipulator elongated arm 62 is then moveable over the stacking station 60 where blanks are deposited and stacked. The conveyor cart 58 receives the stacked blanks at the stacking station and is horizontally moveable to an unloading position U where the stacks of blanks can be removed distal from the stacking station 60.

A controller 68 in communication with the loading table 12, blanking press 16, feed manipulator 18, unloading table 22, and discharge manipulator 24 automatically controls the operation of the apparatus 10.

Figure 2:
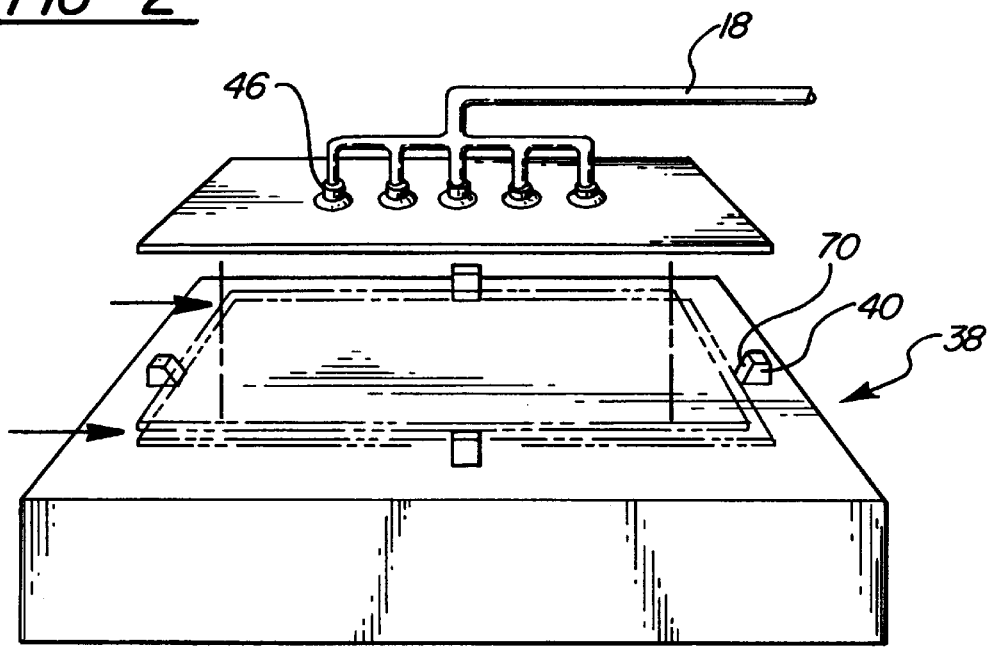
FIG. 2 is a schematic view of the blanking press illustrating gauge blanks mounted on a lower blanking die and a piece of sheet metal being positioned by inclined surfaces of the gauge blocks.
Figure 3:
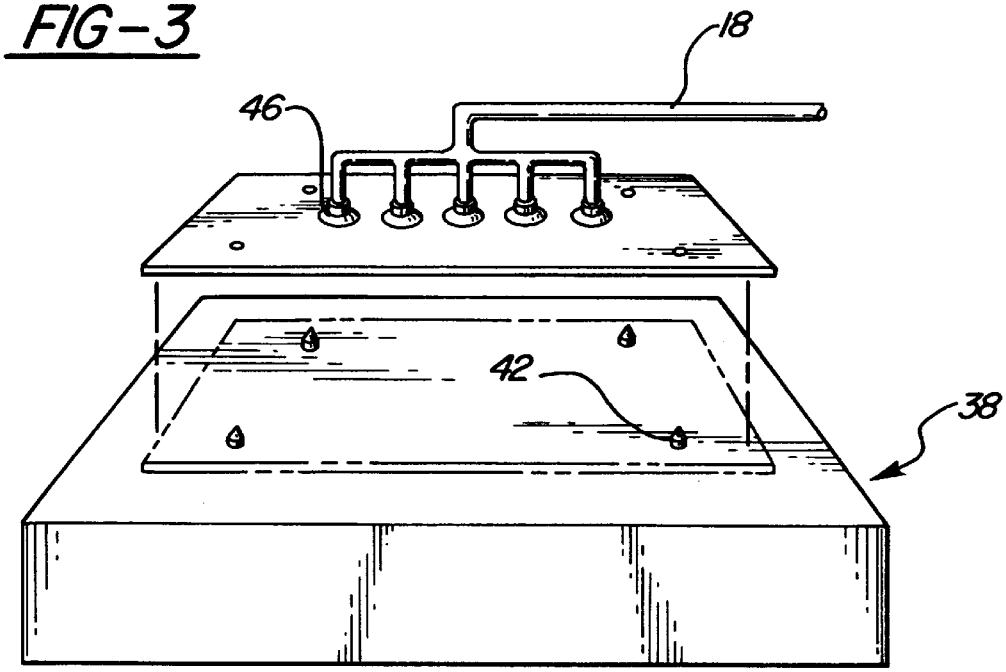
FIG. 3 is a schematic view of the blanking press illustrating gauge pins mounted on the lower blanking die for positioning sheet metal pieces having prefabricated holes located for alignment with the pins/.
Figure 4:
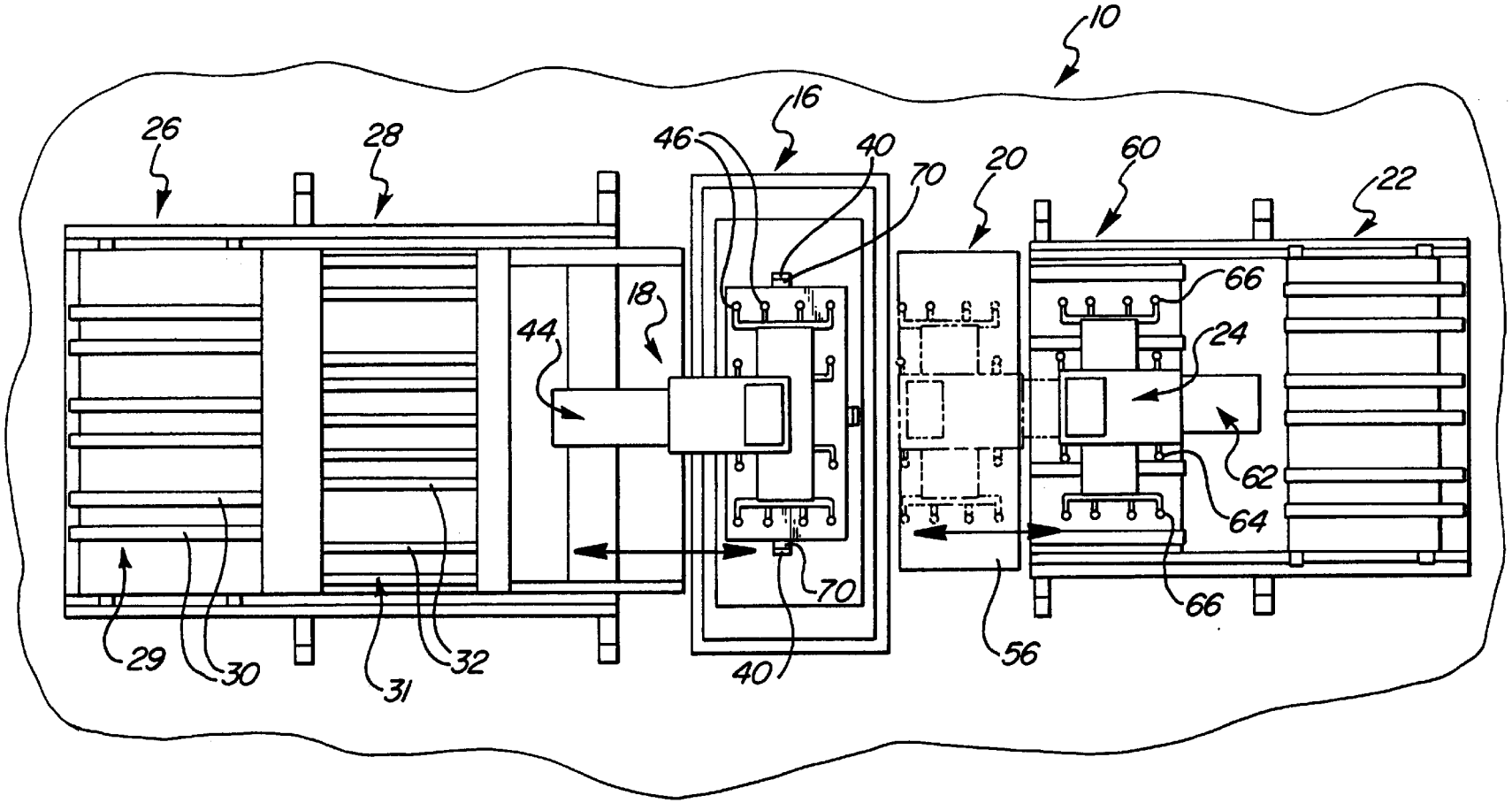
FIG. 4 is a schematic plan view of the automated blanking apparatus of FIG. 1.

In one embodiment of the invention illustrated in FIG. 2 the mechanical positioning means includes gauge blocks 40 having an inclined positioning surface 70. The gauge blocks 40 are positioned in spaced proximity around the perimeter of the sheet metal piece to be blanked. The inclined positioning surface 70 of the gauge blocks 40 slopes toward the center of the lower die 38, causing the sheet metal piece to slide into proper position for blanking as illustrated.

In an alternative embodiment of the invention wherein sheet metal pieces have prefabricated holes, the mechanical positioning means includes gauge pins 42 having an upwardly extending conical shape. The gauge pins 42 are mounted on the lower die 38 in lieu of the gauge blocks 40 and penetrate the prefabricated holes in the sheet metal pieces, thereby aligning the sheet metal pieces relative to the apertures.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. Automated sheet metal blanking apparatus comprising:

a loading table including a conveyor cart and a destacking station; said conveyor cart being horizontally moveable between a loading position wherein sheet metal pieces are loaded onto said conveyor cart and said destacking station wherein said sheet metal pieces are transferred onto said destacking station for subsequent processing;

a qualifier including crowder locating means and being adjacent said loading table for receiving and positioning destacked sheet metal pieces;

a blanking press including a blanking die set comprising a steel rule die for blanking blanks from said sheet metal pieces; said die set including upper and lower dies; said lower die including mechanical positioning means for positioning said sheet metal pieces therein;

a feed manipulator including an elongated arm mounting a plurality of controllable vacuum pickups operable for transferring sheet metal pieces between said destacking station, qualifier and blanking press; said feed manipulator being movable over said destacking station and qualifier, and in between said die set;

a scrap station adjacent said blanking press including scrap receiving means for receiving scrap portions of sheet metal after blanks are sized;

an unloading table adjacent said scrap station including a conveyor cart and a stacking station; said conveyor cart being horizontally moveable between an unloading position wherein sized blanks are unloaded from said conveyor and said stacking station wherein said conveyor cart receives said sized blanks;

a discharge manipulator including an elongated arm mounting at least two distinct pluralities of independently controllable vacuum pickups; said vacuum pickups being simultaneously operable for transferring sheet metal scraps and sized blanks from between said upper and lower blanking press dies to said scrap station where scrap is deposited through the operation of one of the said pluralities of vacuum pickups, and to said unloading table where the sized blanks are deposited; and a controller in communication with said loading table, blanking press, feed manipulator, unloading table, and discharge manipulator for automatically controlling the operation of said apparatus.

2. Apparatus as in claim 1 wherein said positioning means are gauge blocks having an inclined positioning surface, sloping toward the center of said lower die, and being positioned in spaced proximity around the perimeter of the sheet metal piece to be blanked;

whereby as said sheet metal is deposited by said feed manipulator elongated arm on said lower die, said sheet metal slides into proper position for blanking.

3. Apparatus as in claim 1 wherein said positioning means are gauge pins having an upwardly extending conical shape; said gauge pins being mounted on said lower die to penetrate prefabricated holes in said sheet metal pieces, thereby aligning said sheet metal pieces relative to said apertures.

4. Apparatus as in claim 1 wherein said feed manipulator is robotic.

5. Apparatus as in claim 1 wherein said discharge manipulator is robotic.

6. Apparatus as in claim 1 wherein said destacking station includes magnetic separation means for separating stacked sheet steel pieces.

7. Apparatus as in claim 1 wherein said feed manipulator includes a sensor for sensing the number of sheet metal pieces lifted.

8. Apparatus as in claim 1 including air blast means comprising a plurality of nozzles for directing high pressure air in between said dies.

9. Apparatus as in claim 1 wherein said loading table conveyor cart includes a support surface defined in part by a plurality of horizontally disposed, longitudinally extending fingers, horizontally moveable between said loading position and destacking station; and said destacking station includes another support surface defined in part by a corresponding plurality of horizontally disposed, longitudinally extending interconnecting fingers being vertically moveable to elevational positions above and below the elevation of the fingers of the conveyor cart.

10. Apparatus as in claim 1 wherein said unloading table conveyor cart includes a support surface defined in part by a plurality of horizontally disposed, longitudinally extending fingers, horizontally moveable between said unloading position and stacking station; and said stacking station includes another support surface defined in part by a corresponding plurality of horizontally disposed, longitudinally extending interconnecting fingers being vertically moveable to elevational positions above and below the elevation of the fingers of the conveyor cart.

* * * * *